US009743734B2

(12) United States Patent
Bemis

(10) Patent No.: US 9,743,734 B2
(45) Date of Patent: Aug. 29, 2017

(54) PROTECTIVE CASE WITH MULTI-MODE ROTATABLE MAGNETIC POSITIONING AND CLOSURE SYSTEM

(71) Applicant: INCIPIO, LLC, Irvine, CA (US)

(72) Inventor: Michael Bemis, Carson, CA (US)

(73) Assignee: Incipio, LLC, Irvine, CA (US)

( * ) Notice: Subject to any disclaimer, the term of this patent is extended or adjusted under 35 U.S.C. 154(b) by 117 days.

(21) Appl. No.: 14/839,540

(22) Filed: Aug. 28, 2015

(65) Prior Publication Data

US 2016/0058147 A1 Mar. 3, 2016

Related U.S. Application Data

(60) Provisional application No. 62/099,430, filed on Jan. 2, 2015, provisional application No. 62/044,185, filed on Aug. 29, 2014.

(51) Int. Cl.

| | |
|---|---|
| ***A45C 13/10*** | (2006.01) |
| ***A45C 11/00*** | (2006.01) |
| ***H01F 7/02*** | (2006.01) |

(52) U.S. Cl.

CPC ..... *A45C 13/1069* (2013.01); *A45C 11/00* (2013.01); *H01F 7/0263* (2013.01); *A45C 2011/002* (2013.01); *A45C 2011/003* (2013.01)

(58) Field of Classification Search

CPC ..... A45C 13/1069; A45C 11/00; A45C 2011/002; A45C 2011/003; H01F 7/0263; Y10T 24/32

USPC ..... 206/320, 45.2, 45.23, 45.24; 24/303; 292/251.5; 150/118; 455/575.1, 575.8; 361/679.02

See application file for complete search history.

(56) References Cited

U.S. PATENT DOCUMENTS

| | | | | |
|---|---|---|---|---|
| 754,227 A * | 3/1904 | MooG | A47B 23/042 190/16 |
| 1,613,536 A * | 1/1927 | Rose | A45C 11/00 132/315 |
| 5,881,787 A * | 3/1999 | Davis | A45C 13/1069 150/103 |
| 6,772,879 B1 * | 8/2004 | Domotor | A45C 11/00 206/320 |
| 8,807,333 B1 * | 8/2014 | Cooper | A45C 11/00 206/320 |
| 9,215,303 B2 * | 12/2015 | Nyholm | A45C 11/00 |

(Continued)

FOREIGN PATENT DOCUMENTS

AU 2013100893 * 7/2013

*Primary Examiner* — Chun Cheung

(74) *Attorney, Agent, or Firm* — Manatt, Phelps & Phillips, LLP

(57) ABSTRACT

A protective case for a mobile or handheld device is disclosed. The case includes front and rear cover components that are configured to rotate relative to one another so that the case is capable of being configured by the user into have multi-mode use configurations. The case includes a rotatable magnetic clasp that rotates to magnetically secure the case in desired configuration. The magnetic clasp includes a rotatable magnet component attached to one end region of the case and a fixedly positioned and oriented magnet secured to another opposing end region of the case. The rotation of the magnet allows the user to re-orient the polarity of the magnetic component to facilitate mechanical and magnetic retention of the desired configuration.

20 Claims, 7 Drawing Sheets

(56) References Cited

U.S. PATENT DOCUMENTS

| | | | | |
|---|---|---|---|---|
| 9,225,377 | B1 * | 12/2015 | Hart | H04B 1/3877 |
| 9,307,062 | B2 * | 4/2016 | Kim | H04M 1/04 |
| 2004/0183313 | A1 * | 9/2004 | Sherman | A47F 7/03 292/251.5 |
| 2014/0291177 | A1 * | 10/2014 | Ko | G06F 1/1626 206/45.23 |
| 2016/0095402 | A1 * | 4/2016 | Saad | A45C 13/1069 206/45.23 |

* cited by examiner

PROTECTIVE CASE WITH MULTI-MODE ROTATABLE MAGNETIC POSITIONING AND CLOSURE SYSTEM

INCORPORATION BY REFERENCE TO RELATED APPLICATIONS

This application claims benefit under 35 U.S.C. §119(e) from U.S. Provisional Application No. 62/044,185, filed on Aug. 29, 2014 and U.S. Provisional Application No. 62/099,430, filed on Jan. 2, 2015. The disclosures of each of the applications cited in this paragraph are hereby incorporated herein by reference in their entireties.

BACKGROUND OF THE INVENTION

Field of the Invention

This patent document relates to protective cases for mobile or handheld electronic devices and in particular to protective cases that employ magnetic components that operate to secure the configuration of the case in a desired configuration or position.

Description of the Related Art

Protective cases for mobile devices such as tablet computers, smart phones, gaming devices, and the like are known in the art. Some of those cases have multiple configuration modes, such as the open or closed position and/or multiple viewing or typing configurations. Mechanical attachments, such as snaps, zippers, tabs, and/or slots have been used to secure the case in the desired configuration mode. Such mechanical attachments can be cumbersome and burdensome and overtime deteriorate with wear and tear of use. Some cases are also designed to fold-over themselves and thereby provide support to the device in different positions by virtue of the folded-configuration and do not employ additional mechanical attachments to actively secure those modes of use. Such cases, however, can also be unsatisfactory in that they can be amenable to being unintentionally disturbed, such as with a jolt or bump on a plane, train or automobile or when the user moves the case from location to location.

In order to facilitate or enhance the user experience, the inventors here recognized that there is a continuing need to improve the manner by which use configurations of a multi-mode use case can be secured.

SUMMARY OF THE INVENTION

There exists a continuing need for new and improved protective cases that can readily and easily facilitate and secure into position the case in a desired configuration or mode of use. Various aspects are summarized below.

One aspect relates to multi-mode protective case comprising a first cover element that includes a first magnetic element attached in fixed orientation and polarity relative thereto and a second cover element that includes a second magnetic element attached in rotatable orientation and polarity relative thereto. The second magnetic element includes a first face that has the same polarity as the outer facing surface of the first magnetic element and a second face that has the opposite polarity of the outer facing surface of the first magnetic element. The second face of the second magnetic element is dimensioned and configured to mate with the outer facing surface of the first magnetic element when positioned adjacent thereto. The first cover element and second cover element each include an inner surface and an opposing outer surface with the first and second cover elements being rotatably coupled directly or indirectly (through one or more intermediary elements or component structures) to one another. When the case is in the closed position, the second magnet can be positioned over the first magnet and rotatably oriented so that opposing polarities of the first and second magnet are facing one another and magnetically attract one another. When the case is in the open view mode, such that the inner surfaces of the first cover element and the inner surface of the region of the second cover elements where the second magnet is attached are generally facing away from one another, the second face of the second magnet can be rotated 180° so that it is oriented to face the outer facing surface of the first magnetic surface.

The construction and configuration of each of the magnets and the housings and assemblies thereof as illustrated and disclosed herein, and in relationship with the cover components, constitute additional individual aspects.

Various aspects described in connection with the embodiments of the protective case disclosed herein, including the drawings and claims, may be combined to form claims for a device, apparatus, system, methods of manufacture and/or use in any way without limitation.

BRIEF DESCRIPTION OF THE DRAWINGS

Features, aspects and advantages are described below with reference to the drawings, which are intended to illustrate but not to limit the invention. In the drawings, like reference characters denote corresponding features consistently throughout similar embodiments.

FIG. 1A depicts the case in the closed position with the magnetic positioning and closure system moving into position to secure the closed position in place. FIG. 1B depicts the case in an open view mode configuration with the magnetic positioning and closure system rotated into position to secure the open view mode configuration in place.

DETAILED DESCRIPTION OF THE PREFERRED EMBODIMENT

Disclosed herein is a protective case 10 for a mobile or handheld electronic device 900 that includes magnetic elements and components that operate to secure the configuration of the mobile/handheld device and protective cover in different configuration modes (e.g., closed mode and type/view mode). In the illustrated embodiment mobile device 900 is in the form of a tablet computer that includes a front surface 910 and a rear surface 92. When the case 10 in a type/view mode, the user can access the front surface 910 (which contains the touchscreen) of the mobile device 900. It should be understood however, that the teachings herein are not limited to cases for tablet computers but are applicable to any case for a mobile or hand held device (e.g., smart phones, gaming devices or other computing devices with screens) in which multiple configuration modes are desired.

Figure 4:
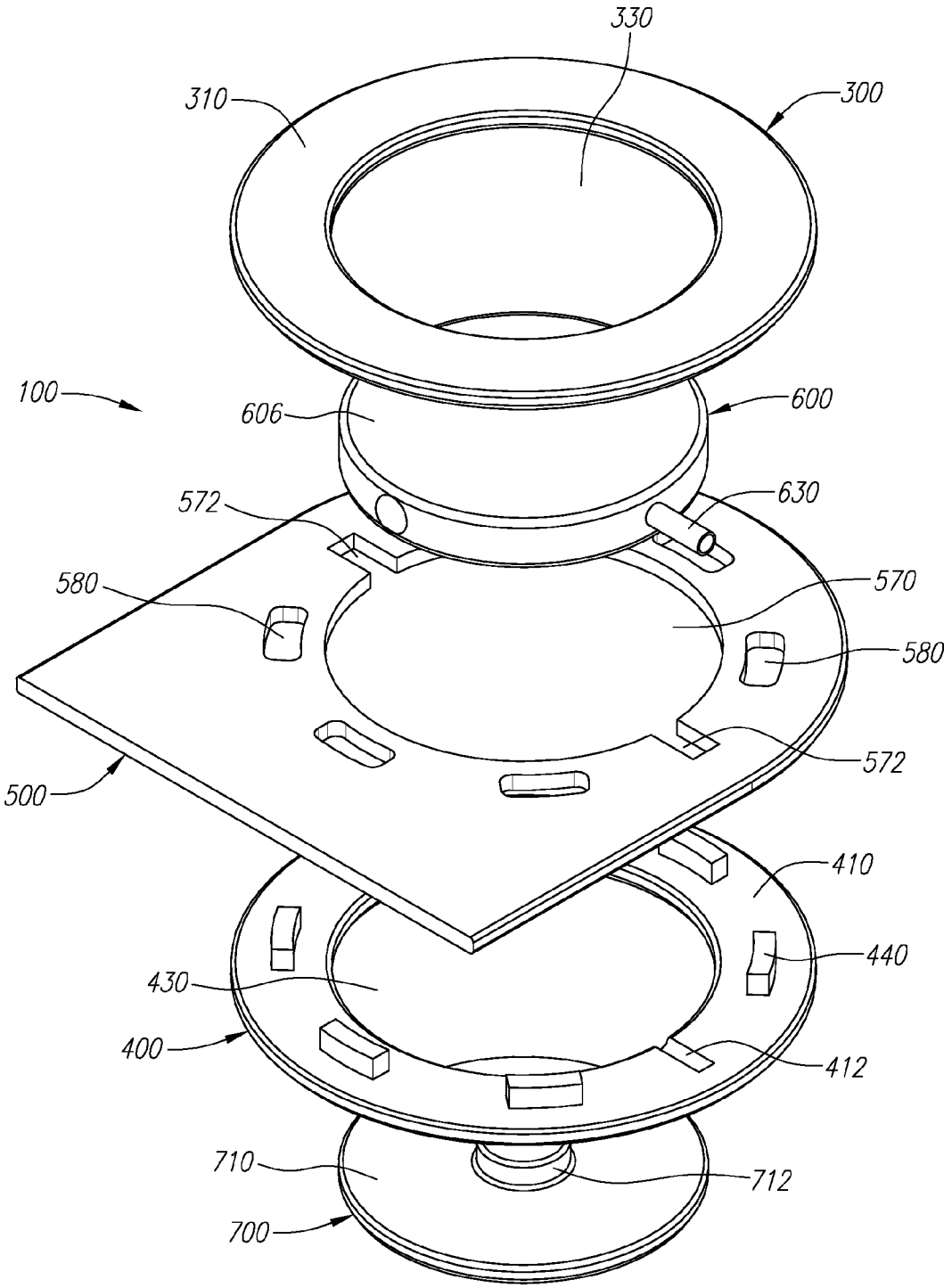
FIGS. 4-6 are exploded views of the rotatable magnetic positioning and closure system illustrated in FIGS. 1A-1B depicted separately without the protective case being attached thereto.
Figure 5:
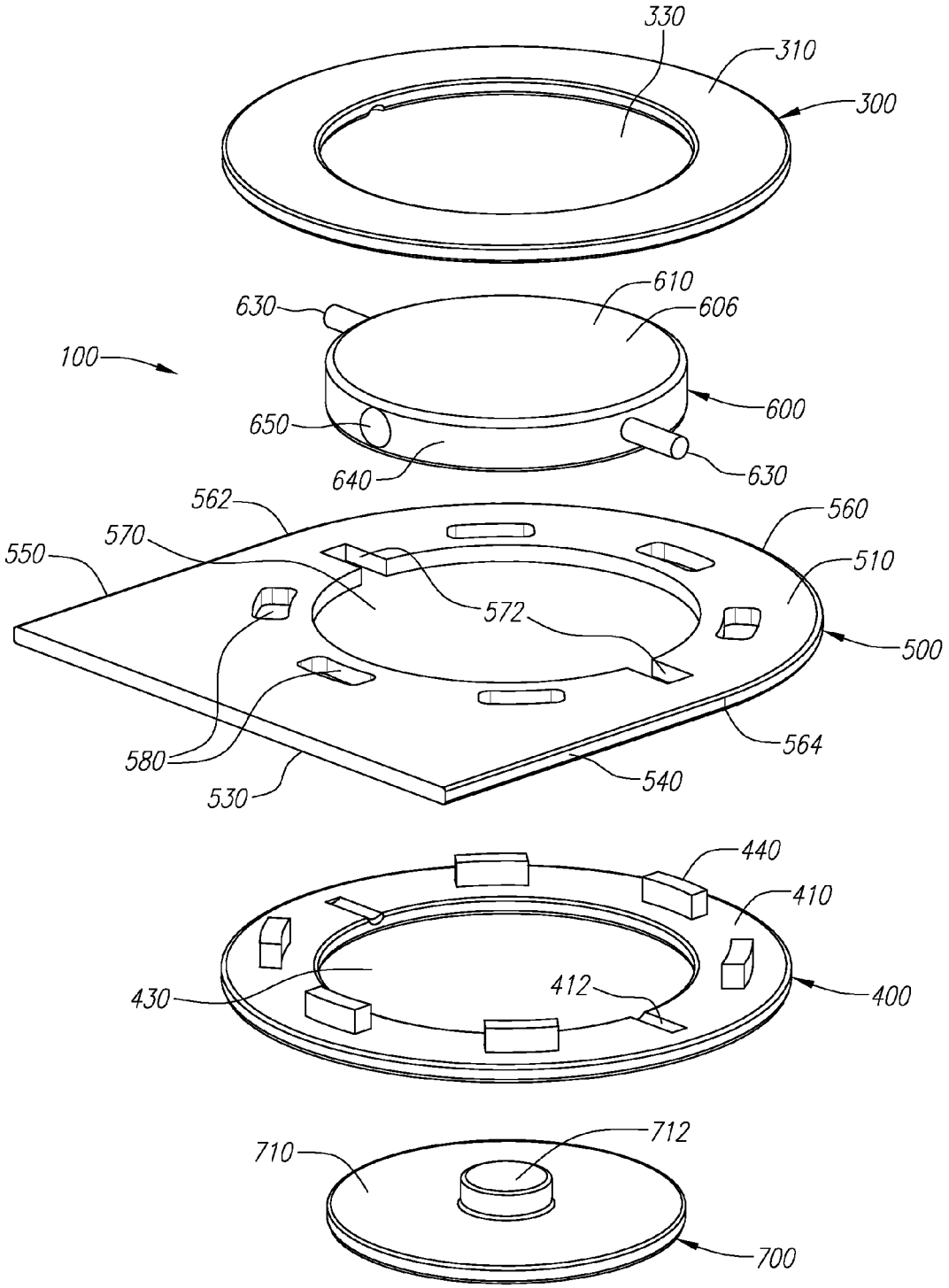
Figure 6:
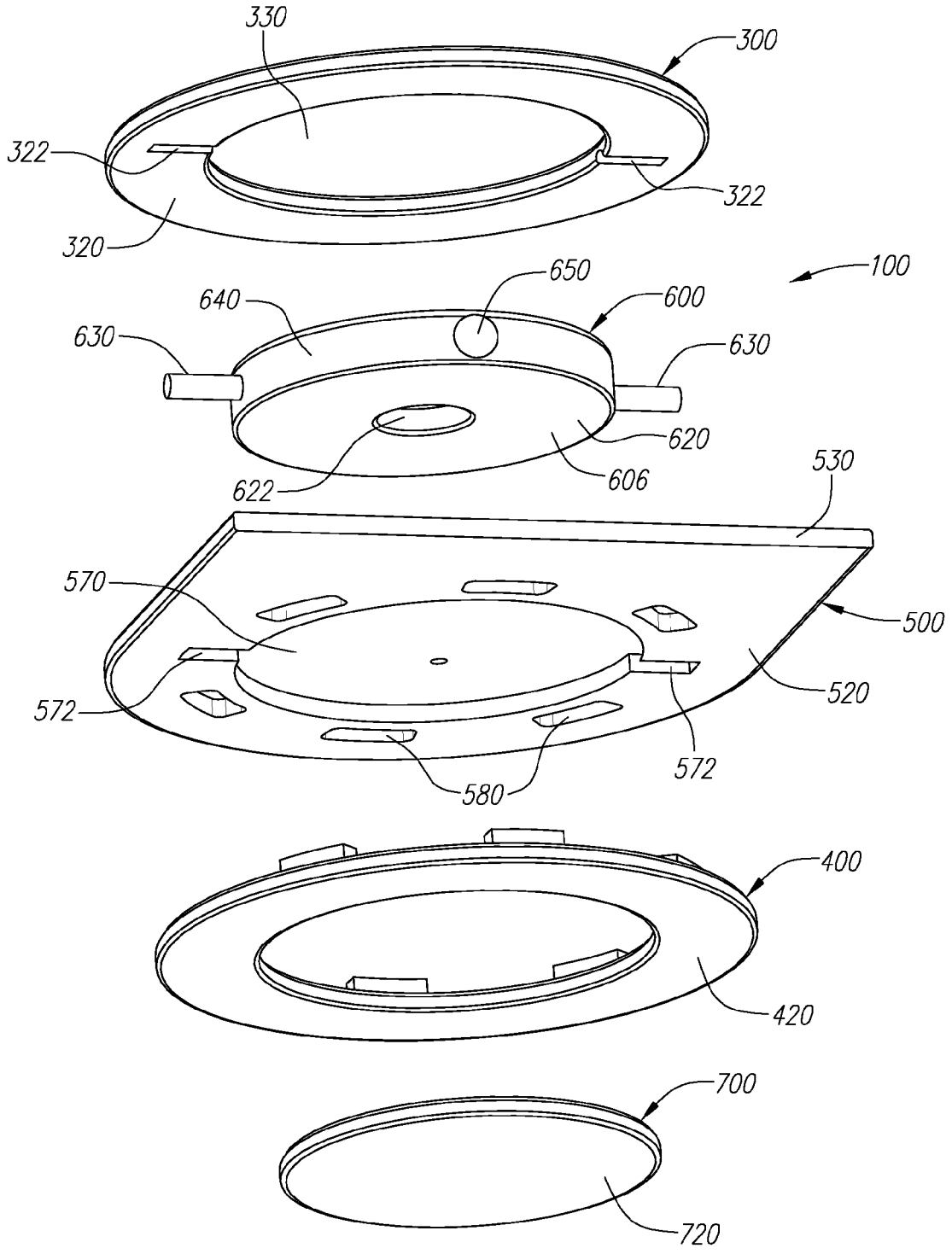

FIGS. 1-7 depict various aspects of a protective case 10 for a mobile device 900 (in the form of a tablet computer contained therein) having a multi-mode rotatable magnetic positioning and closure assembly or system 100 (best illustrated in FIGS. 4-6). FIG. 1A depicts the case 10 in the closed position with the magnetic positioning and closure system 100 moving into position to secure the case in the closed position. FIG. 1B depicts the case 10 in an open view/type mode configuration with the magnetic positioning and closure system 100 rotated into position to secure the case in the open view mode configuration.

The multi-mode protective case 10 includes a cover 800 having a rear cover component or region 810 and a front cover component or region 820. The rear cover 810 includes a magnetic element 700 attached in fixed orientation and polarity relative thereto. The front cover 820 includes a magnetic element 200 attached in rotatable orientation and polarity relative thereto. The rear cover 810 and the front cover 820 rotatably coupled directly or indirectly (e.g., through one or more intermediary elements or components) to one another and each include an inner surface and an opposing outer surface. The connection between the first and second cover elements may be in the form of one or more mechanical or living joints or hinges.

The rotatable magnetic element 200 comprises a rotatable magnetic component 606 with a first face 610, which may have the same polarity as the outer facing surface 710 of the magnetic element 700 (which has fixed orientation) and a second face 620 having the opposite polarity of the outer facing surface 710 of the fixed oriented magnetic element 700. The second face 620 of the rotatable magnet 606 is dimensioned and configured to mate with the outer facing surface 710 of the fixed oriented magnetic element 700 when positioned adjacent thereto. While in one embodiment the first face 610 of the rotatable magnetic component 606 may be in the form of a magnet or otherwise magnetized so as to have the same polarity as the outer face 710 of the fixed oriented magnetic element 700, it should be understood that the first face 610 may formed of nonmetallic or other material that need not be magnetized at all or may have limited magnetic force.

Figure 1A:
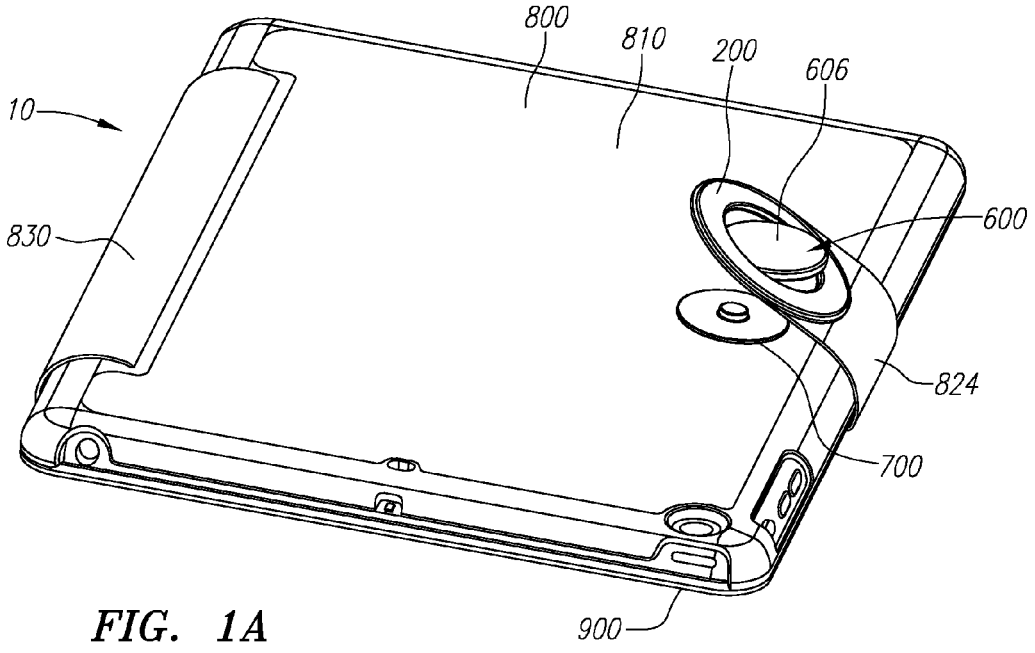
FIGS. 1A-1B depict a protective case for a mobile device (in the form of a tablet computer contained therein) having a multi-mode rotatable magnetic positioning and closure system.
Figure 1B:
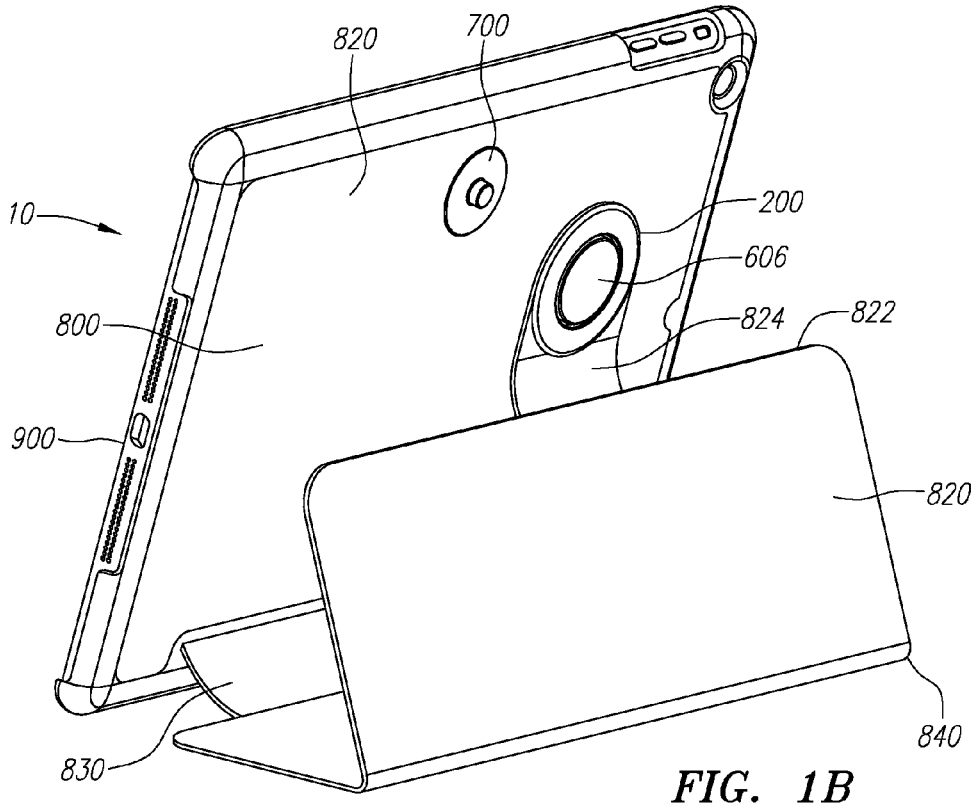
Figure 2A:
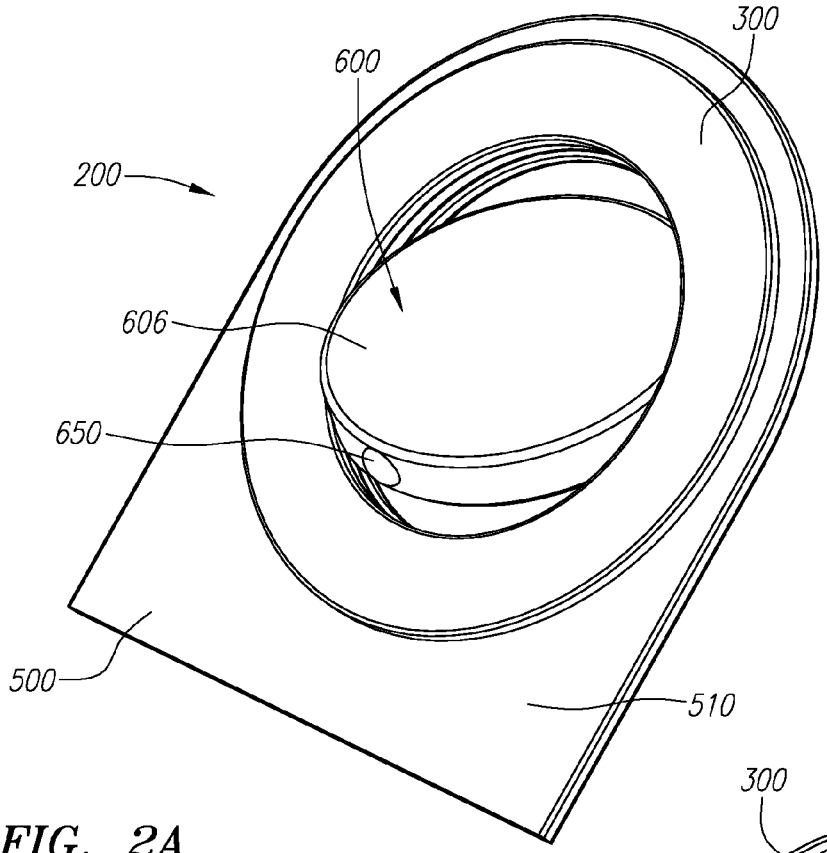
FIGS. 2A-2B are perspective views of the assembled rotatable magnet and housing component of the magnetic positioning and closure system illustrated in FIGS. 1A-1B. The rotatable magnetic and housing component being depicted separately without the protective case being attached thereto.
Figure 2B:
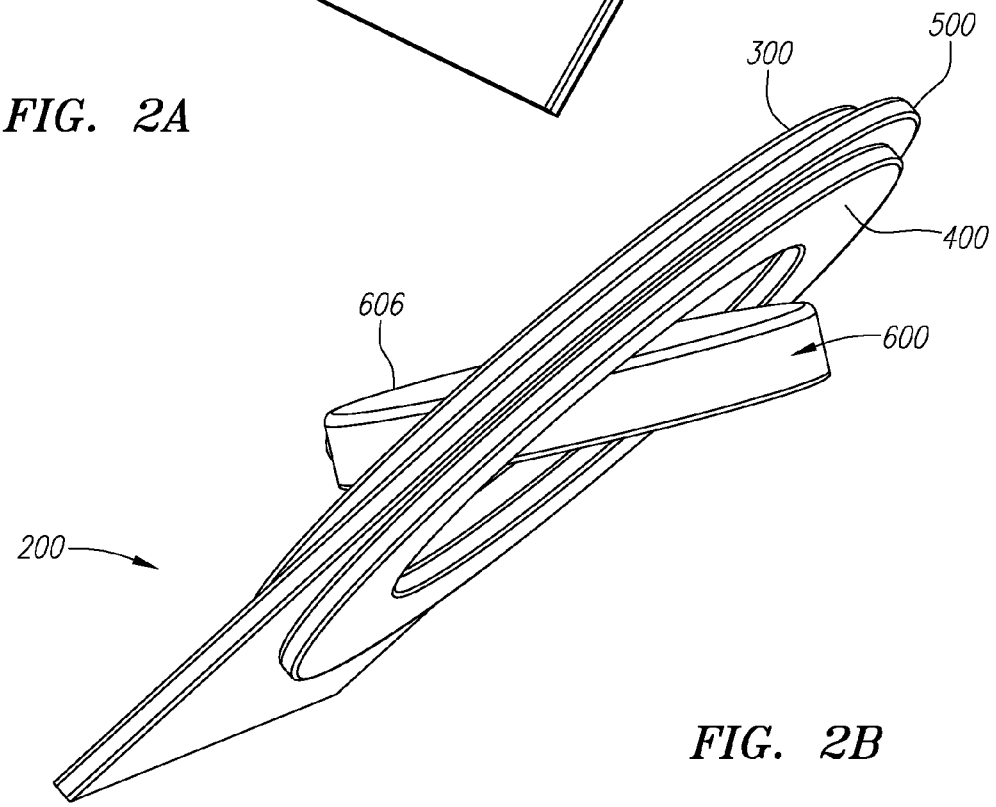
Figure 3A:
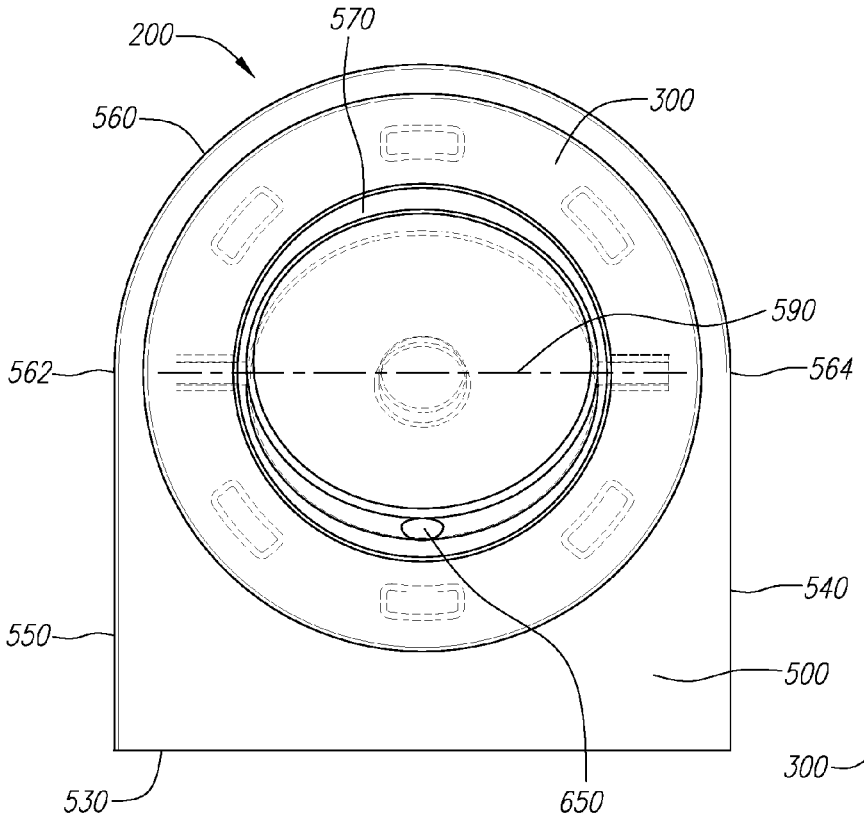
FIGS. 3A-3B illustrate a front view and a side view of the assembled rotatable magnet and housing component of the magnetic positioning and closure system illustrated in FIGS. 1A-1B. To illustrate the rotatability of the magnet, the magnet is depicted as being partially rotated so that it is not planar with the housing assembly.
Figure 3B:
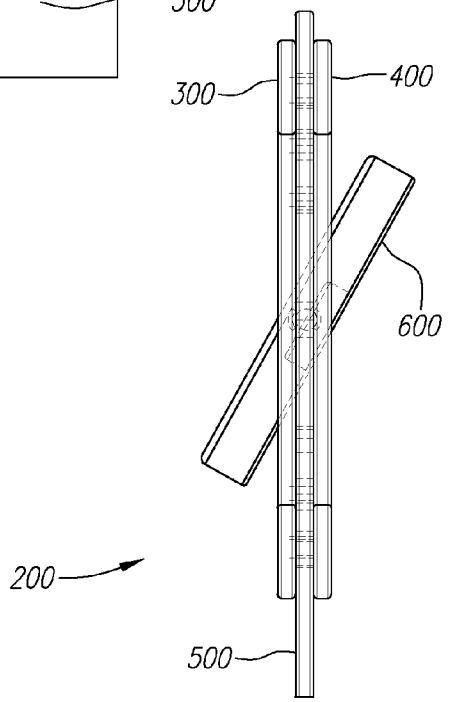

With reference to the detailed views of the magnetic positioning and closure assembly 100 depicted in FIGS. 4-6, when the case is in the closed position as shown in FIG. 1A, the rotatable magnetic element 200 can be positioned over the fixed oriented magnetic element 700 and rotatably oriented so that opposing polarities of the rotatable magnet 606 and the fixed oriented magnetic element 700 are facing one another and thereby aligned to magnetically attract one another. When the case is in the open view mode as shown in FIG. 1B, such that the inner surfaces of the rear cover 810 and the inner surface of the region of the front cover 820 where the rotatable magnetic element 200 is attached are generally facing away from one another, the second face 620 of the rotatable magnet 606 can be rotated 180° degrees so that it is oriented to face the outer facing surface 710 of the fixed oriented magnetic element 700. Thus, the magnetic positioning and closure assembly 100 allows for rotation of the magnetic component 606 so that the second face 620 can be rotated to face the outer facing surface 710 of the fixed magnetic component element 700 in both the open and closed configurations of the case 10. At the same time the first face 610 may maintain an outwardly facing orientation. The first face 610 thereby provides for a convenient location for a logo or brand mark or other design element which may be molded, adhered, engraved, etched, or otherwise incorporated or located thereon so as to be visible in both the closed and open use modes or position.

With particular reference to FIGS. 2A-6, the magnetic positioning and closure assembly 100 comprises a rotatable magnet and housing assembly 200 and the fixed oriented magnet 700. Commonly disclosed in FIGS. 2A-3B are perspective views, front view and side view of the representative rotatable magnet and housing assembly 200. Commonly disclosed in FIGS. 4-6 are exploded views of the representative magnetic positioning and closure assembly 100 that include depictions of the fixed oriented magnet 700 component.

As illustrated therein, the rotatable magnet and housing assembly 200 comprises an upper ring 300, a lower ring 400, a frame 500, and a rotatable magnet assembly or element 600. The frame 500 has a front facing surface 510, a rear facing surface 520, a first side 530, a second side 540, a third side 550, and a semicircular forth side 560. It should be understood, however, that the frame 500 may have other configurations, such as square or circle configurations, may be used for the frame 500. Similarly it should be understood that the magnet 606 may have other configurations than the circular disc shape illustrated, for example it may also be rectangular, square, trapezoidal, curved, elliptical, boxed, an/or spherical or any combination of such shapes or portions thereof.

The frame 500 may be made out of polyurethane (PU), or other suitable material capable providing a relatively rigid and preferably durable and abrasion resistant structure and surface. Alternatively, other materials can be used for making the frame 500, including metals, wood, stone, ceramics, and other polymers.

An aperture 570 sized to receive the rotatable magnet assembly 600 can be cut through or otherwise extend through the front and rear facing surfaces 510, 520 of the frame 500. In the present embodiment, the aperture 570 has a circular shape. It should be understood, however, that the aperture 570 can take other shapes, for example, square or rectangular shapes that correspond in shape and dimension to allow the magnet component 606 to rotate therein.

Two slots or channels 572 on opposing sides of the aperture 570 function as bearings dimensioned to receive and support the rod, pin or shaft 630 of the rotatable magnet assembly when rotating within the aperture 570.

The frame 500 can have a plurality of retention/positioning slots 580 sized to receive and secure protrusions 440 from the lower ring 400.

In the present embodiment, the intersection of the third side 550 and the forth side 560 is a left axis line demarcation 562 and the intersection of the second side 540 and the forth side 560 is a right axis line demarcation 564. The line passing through both the left axis line demarcation 562 and the right axis line demarcation 564 is the axis of rotation 590 of the magnetic component 606, which in turn corresponds with the position of the channels 572. However, it should be understood that other axis lines of rotation may be employed depending from the shape of the frame 500 and the shape of the magnetic assembly 600, and the aperture 570.

The rings 300, 400 to be placed on the opposite sides of the frame 500 include a upper ring 300 and a lower ring 400. The upper ring 300 has an outer face 310 and an inner face 320 and a circular opening 330 extending there-through with a diameter sized substantially the same as the circular aperture 570 of the frame 500. It should be understood, however, that the opening 330 can take other shapes, for example, square or rectangular shapes that may or may not correspond in shape and dimension to the aperture 570 of the frame 500. The inner face 320 of the upper ring 300 includes cavities 322 (best seen in FIG. 6) that are positioned to be aligned with the slots 572 of the frame 500 when the rotatable magnet and housing assembly 200 is assembled.

The lower ring 400 has an inner face 410 and an outer face 420 and a circular opening or aperture 430 extending there-through with a diameter sized substantially the same as the circular aperture 570 of the frame 500. It should be understood, however, that the aperture 430 can take other shapes, for example, square or rectangular shapes that may or may not correspond in shape and dimension to the aperture 570 of the frame 500. The inner face 410 of the lower ring 400 also includes cavities 412 that are positioned to be aligned with the slots 572 of the frame 500 when the rotatable magnet and housing assembly 200 is assembled. The inner face 410 of the lower ring 400 further includes a plurality of protrusions 440 for mating with the retention/positioning slots 580 on the frame 500.

The upper and lower rings 300, 400 may be made out of plastic or other suitable polymer and ultrasonically welded to one another after assembled to the frame. The protrusions 440 on the inner face 410 of the lower ring 400 can serve as energy directors when the top and lower rings 300, 400 are ultrasonically welded together. It should be understood, however, that the top and lower rings 300, 400 can be bonded together by other suitable methods or means. For example, the top and lower rings 300, 400 may be made out of other materials (such as metal) and retained together via a press fit (or interference fit). The upper and lower rings 300, 400 may be bonded together using adhesive, or snap fit into one another directly or into the frame 500 or may be bolted or riveted together. Any suitable attachment method may be employed.

In the present embodiment, the rotatable magnet assembly 600 is configured to include a rotatable magnet component 606 having a circular shape. It should be understood, however, that the rotatable magnet 606 can take other shapes, for example, square or rectangular shapes to correspond to the aperture 570 of the frame 500. The rotatable magnet 606 has a first face 610 having a first polarity (e.g., positive polarity) and a second face 620 having a second polarity that is opposite to the first polarity (e.g., negative polarity).

The rotatable magnet 606 can be held or carried by a magnet retention ring 640 that is configured to encircle the perimeter of the magnet component 606. Two opposing rods 630 that are sized to fit into the slots 572 of the frame 500 and cavities 322 and 412 of the upper and lower rings 300, 400 extend from opposing sides of the magnet retention ring 640. When the rods 630 are installed or positioned in the slots 572 of the frame 500 and the top and lower rings 300, 400 are assembled thereto so as to form the rotatable magnet and housing assembly 200, the rotatable magnet assembly 600 rotates freely along the axis of rotation 590 and the opposing rods 630 aligned therewith within the slots 572 and cavities 322, 412. Thus, the orientation of the polarity of the rotatable magnet 606 within the housing assembly 200 is changeable.

A snap alignment cavity or alignment protrusion receptor 622 can be positioned at the center of the second face 620 of the rotatable magnet 606 to form a female side of a magnetic snap. The snap alignment cavity/receptor 622 can be a round or cylindrical in shape or may take other shapes (e.g., rectangular, triangular, or other curved shapes) but is generally configured to receive and conform in shape with a rod from a corresponding male magnetic snap (e.g., the alignment protrusion 712 located on the outer facing surface of fixed magnet 700.

In order to maintain the relative orientation and polarity of magnet 606 vis-à-vis its surrounding housing, a detent/catch/protrusion element 650 may be provided on the magnet retention ring 640 of the rotatable magnet assembly 600. In operation, the protrusion 650 would catch between the upper and lower ring 300, 400 and thereby latch the rotatable magnet assembly 600 in the desired orientation relative the frame 500. The protrusion would be dimensioned so that the user could readily change the relative orientation of the magnet component 606 by asserting pressure to dislodge the protrusion 650 from in between the two rings 300, 400 and re-lodge the protrusion 650 at the opposing sides of the rings after being rotated 180 degrees.

When the upper ring 300, lower ring 400, frame 500, and rotatable magnet assembly 600 are assembled to form the rotatable magnet and housing assembly 200, the upper and lower rings 300, 400 sandwich both the rotatable magnet assembly 600 and the frame 500.

As best illustrated in FIGS. 4-6, the fixed oriented magnet 700 can be coupled with the rotatable magnet and housing assembly 200 to form the magnetic positioning and closure assembly 100. The fixed oriented magnet 700 has an outer facing surface 710 having a first polarity and an inner facing surface 720 opposite to the outer facing surface 710 and having a second polarity that is opposite from the first polarity. As previously noted an alignment protrusion 712 may be provided at the center of outer facing surface 710 of the fixed oriented magnet 700 and dimensioned to fit within the snap alignment cavity/receptor 622 of the rotatable magnet 606. While the illustrated embodiment depicts the female end of the magnetic snap being positioned on the magnetic component 606 and the male end 712 of the magnetic snap being positioned on the magnet 700, it should be understood, that the male and female ends may be formed in reversed configuration.

The polarity of the outer facing surface 710 of the fixed oriented magnet 700 may be either positive ("+") or negative ("−"). In either case, the polarity of the second face 620 of the rotatable magnet 606 is configured to be opposite to the polarity of the outer facing surface 710 of the fixed oriented magnet 700. Thus, for example when the polarity of the outer facing surface 710 of the fixed oriented magnet 700 is positive ("+"), the polarity of the second face 620 of the rotatable magnet 606 is negative ("−"), and the polarity of the first face 610 of the rotatable magnet 606 is positive ("+").

As shown in FIGS. 1A-1B, the fixed oriented magnet 700 is mounted to the rear cover or shell 810 of the cover 800 while the rotatable magnet and housing assembly 200 is attached to a tab 824 which is mounted to the edge 822 of the front cover 820 of the cover 800. As an example, the outer facing surface 710 of the fixed oriented magnet 700 has a positive polarity as shown in the positive ("+") sign.

When the case 10 is in a closed position so that the front and back faces of the mobile device 900 is protected by the cover 800 (as shown, for example, in FIG. 1A), the user can rotate the rotatable magnet assembly 600 so that its second face 620 is facing the outer facing surface 710 of the fixed oriented magnet 700. In this example, the polarity of the second face 620 of the rotatable magnet 606 is negative, as shown in the negative ("–") sign, the magnetic force between the fixed oriented magnet 700 and the rotatable magnet 606 would close the case 10.

One advantage of using the alignment protrusion 712 and snap alignment cavity/receptor 622 is that the magnetic positioning and closure assembly 100 has a bias that promotes the self-alignment of the case when magnet components 606 and 700 approach and engage one another.

Figure 7:
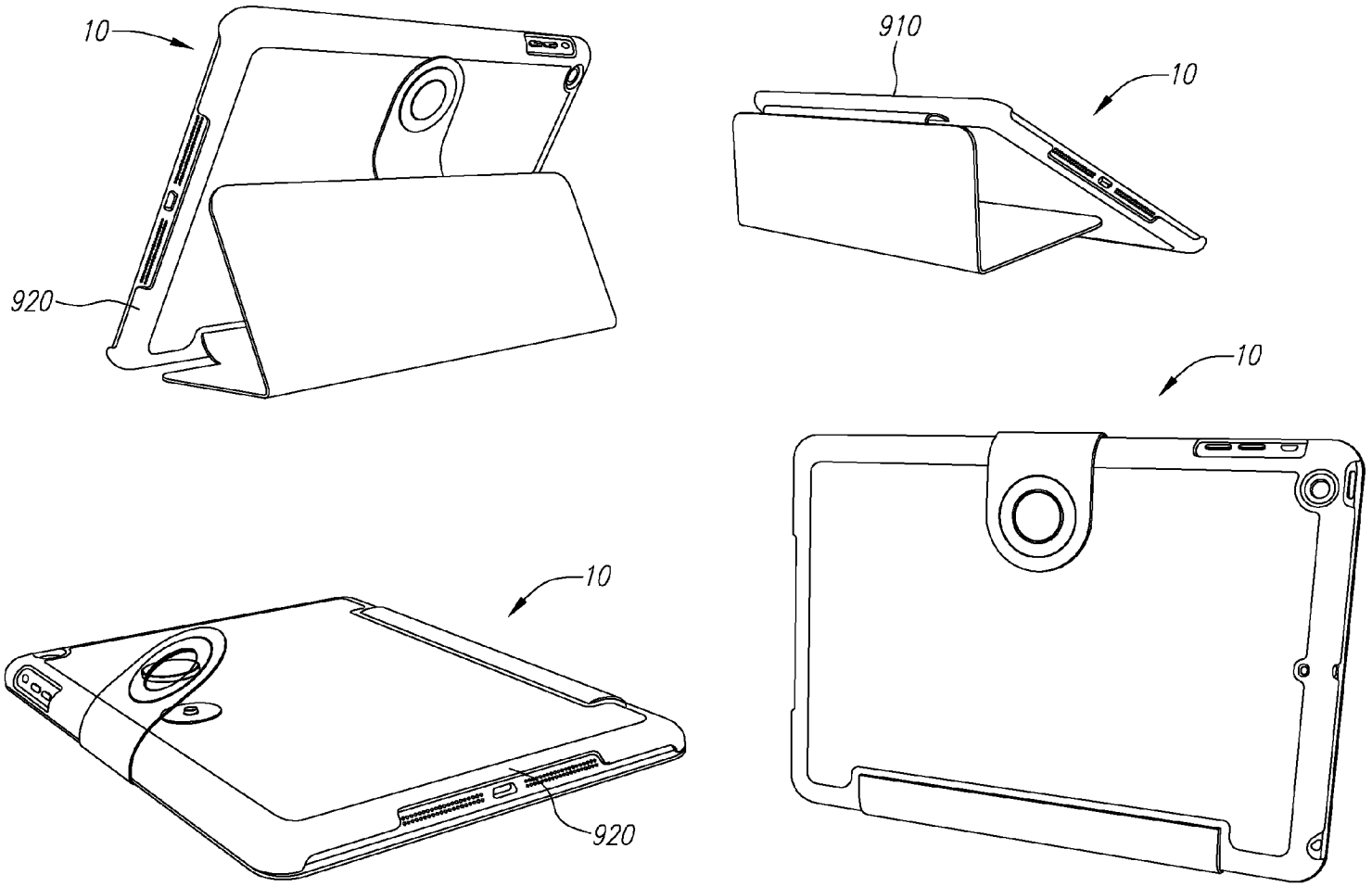
FIG. 7 shows additional illustrations of the protective case illustrated in FIGS. 1A-1B in the open and closed configuration positions to further illustrate the operability, configuration and construction of the case.

FIG. 7 further illustrated the protective case illustrated in FIGS. 1A-1B in the open and closed configuration positions to further illustrate the operability, configuration and construction of the case 10.

Generally, in operation, when the case 10 is in a closed mode as shown in FIG. 1A, a user can detach the magnets 606/700 from one another, unwrap the front cover 820 along a spine 830 and let the front cover 820 fold along the fold-line/joint 840 to form a typing or view mode configuration as shown in FIG. 1B. When the user folds the cover components back on themselves to achieve the open position illustrated in FIG. 1B, the rotatable magnet 606 needs to be re-oriented by rotating it 180 degrees so that face 620 is facing the outer facing surface 710 of the fixed oriented magnet 700. If the magnet component 606 is not rotated so that the opposing polarities are aligned, the magnetic force between the fixed oriented magnet 700 and the rotatable magnet 606 would repel or push the rotatable magnet and housing assembly 200 away from the fixed oriented magnet 700. In order to fix the position of the case 10 in the desired position, the user would therefore need to rotate the rotating magnet 606 around 180° to make the second face 620 of the rotatable magnet 606 face the outer facing surface 710 of the fixed oriented magnet 700 as shown in FIG. 1B. Once the magnet component 606 is re-oriented , the rotatable magnet and housing assembly 200 and the fixed oriented magnet 700 are aligned and may be coupled together so that magnetic force between the fixed oriented magnet 700 and the rotatable magnet 606 assists in securing the case 10 in the type/view mode.

It is contemplated that more than one fixed magnetic snaps can be placed on the rear cover 810. For example, a second fixed magnetic snap (not shown) can be placed at a location lower than the position of the fixed oriented magnet 700 shown in FIG. 1B. When the rotatable magnet and housing assembly 200 is coupled to the second fixed magnetic snap instead of the first fixed oriented magnet 700, a second position of type/view mode may be achieved. In this configuration, the second position of type/view mode would position the mobile device 900 at a steeper plane relative to the supporting surface than the first one mode of view.

When it is desired to change the case 100 from the type/view mode as shown in FIG. 1B to the closed mode as shown in FIG. 1A, the user can separate the rotatable magnet and housing assembly 200 from the fixed oriented magnet 700 and wrap the front cover 820 about the spine 830 from the type/view mode to the closed mode configuration and re-orient the rotatable magnet 606 180° degrees so that the second face 620 of the rotatable magnet 606 faces the outer facing surface 710 of the fixed oriented magnet 700 as shown in FIG. 1A. The rotatable magnet and housing assembly 200 and the fixed oriented magnet 700 can then be coupled together with the magnetic force between the fixed oriented magnet 700 and the rotatable magnet 606 assisting to secure the case 10 in the closed mode. The protrusion 650 on the magnet assembly 600 can assist in retaining the selected orientation of the magnet component 606.

Thus, the representative magnetic positioning and closure assembly 100 described herein allows the user to mechanically and magnetically secure the case 10 in both a closed mode and a type/view mode.

It should be understood, however, that the various aspects and teachings herein are not limited to any particular mobile device or protective case configuration but have wide applicability. Although inventive aspects have been disclosed in the context of certain preferred implementations and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated herein that various combinations or sub-combinations of the specific features, components and aspects of the embodiments may be made and fall within the scope of this invention. Thus, it is intended that the scope of the present invention herein disclosed should not be limited by the particular disclosed embodiments but, should be determined by the fair reading of the claims that follow.

What is claimed is:

1. A protective case for a mobile device having a back cover having a back facing surface and a front facing surface that configured to receive and retain the mobile device in a position fixed relative to said back cover and a front cover configured to rotate in one direction over the mobile device and in another direction over the back facing surface of the of the back cover, said protective case further having a closed configuration mode wherein said front cover is rotated over the front facing surface of said back cover and an open configuration mode wherein said front cover is rotated over the back facing surface of said back cover, said protective cover further comprising a magnetic closure comprising:

a fixed magnetic snap component mounted on a first position of a back cover; and a rotatable magnetic snap assembly mounted on a second position of the case on the front cover, wherein the rotatable magnetic snap assembly comprises a housing and a rotating magnet rotatably secured within the housing, and wherein the rotating magnetic snap assembly and the fixed magnetic snap are configured to be magnetically coupled together to secure the case in position in both the open configuration mode and the closed configuration mode.

2. A protective case for a mobile device having a back cover having a back facing surface and a front facing surface that configured to receive and retain the mobile device in a position fixed relative to said back cover and a front cover configured to rotate in one direction over the mobile device and in another direction over the back facing surface of the of the back cover, said protective case further having a closed configuration mode wherein said front cover is rotated over the front facing surface of said back cover and an open configuration mode wherein said front cover is rotated over the back facing surface of said back cover, said protective cover further comprising a magnetic closure comprising:

a fixed magnetic snap component mounted on a first position of a back cover; and a rotatable magnetic snap assembly mounted on a second position of the case on the front cover, wherein the rotating magnetic snap assembly and the fixed magnetic snap are configured to be magnetically coupled together to secure the case in position in both the open configuration mode and the closed configuration mode, wherein the rotating magnetic snap assembly includes a magnetic component that is rotatably secured within an aperture of a housing that is mounted at an opposing end region of the case relative to position of the fixed magnetic snap.

3. The protective case of claim 1 further comprising a second fixed magnetic snap mounted on the back surface of the back cover of the case.

4. The protective case of claim 2, wherein the rotating magnetic snap assembly includes a protrusion extending from the magnetic component that is dimensioned to catch the aperture of the housing to retain the magnetic component in a selected orientation.

5. The protective case of claim 2, wherein the rotatable magnetic snap assembly comprises:

an upper ring;

a lower ring;

a frame; and a rotating magnet, wherein the frame is sandwiched between the upper and lower rings to form a housing and the rotating magnet is rotatably secured within the housing.

6. The protective case of claim 5, wherein the rotating magnet is positioned within a retention support that includes two protrusions extending in opposing direction from the retention support, wherein the two protrusions are rotatably held within slots formed within the housing.

7. The protective case of claim 1, wherein when magnetically securing the cover in the closed configuration mode, the magnet is rotated 180 degrees relative to the position when magnetically securing the cover in the open configuration mode.

8. The protective case of claim 5, wherein the frame has a plurality of apertures sized to receive a plurality of protrusions extending from the lower ring.

9. The protective case of claim 8, wherein the plurality of protrusions of the lower ring serve as energy directors when the upper and lower rings are ultrasonically welded.

10. The protective case of claim 9, wherein the upper and lower rings are made of plastic.

11. The protective case of claim 9, wherein the frame is made of polyurethane.

12. The protective case of claim 1, wherein the fixed magnetic snap includes a protrusion that is dimensioned to mate with an alignment cavity contained within an oppositely polarized surface of the rotatable magnet.

13. A protective case for a mobile device having a back cover having a back facing surface and a front facing surface that configured to receive and retain the mobile device in a position fixed relative to said back cover and a front cover configured to rotate in one direction over the mobile device and in another direction over the back facing surface of the of the back cover, said protective case further having a closed configuration mode wherein said front cover is rotated over the front facing surface of said back cover and an open configuration mode wherein said front cover is rotated over the back facing surface of said back cover, said protective cover further comprising a magnetic closure comprising:

a fixed magnetic snap component mounted on a first position of a back cover; and a rotatable magnetic snap assembly mounted on a second position of the case on the front cover, the rotatable magnetic snap assembly comprises an upper ring, a lower ring, a frame, and a rotating magnet, wherein the frame is sandwiched between the upper and lower rings to form a housing, and wherein the rotating magnet is rotatably secured within the housing, and wherein the rotating magnetic snap assembly and the fixed magnetic snap are configured to be magnetically coupled together to secure the case in both the open configuration mode and the closed configuration mode.

14. The protective case of claim 13, further comprising a second fixed magnetic snap mounted on the back surface of the back cover of the case.

15. The protective case of claim 13, wherein the rotating magnetic snap assembly includes a protrusion extending from the magnetic component that is dimensioned to catch the aperture of the housing to retain the magnetic component in a selected orientation.

16. The protective case of claim 13, wherein the rotating magnet is positioned within a retention support that includes two protrusions extending in opposing direction from the retention support, wherein the two protrusions are rotatably held within slots formed within the housing.

17. The protective case of claim 13, wherein when magnetically securing the cover in the closed configuration mode, the magnet is rotated 180 degrees relative to the position when magnetically securing the cover in the open configuration mode.

18. The protective case of claim 13, wherein the frame has a plurality of apertures sized to receive a plurality of protrusions extending from the lower ring.

19. The protective case of claim 18, wherein the plurality of protrusions of the lower ring serve as energy directors when the top and lower rings are ultrasonically welded.

20. The protective case of claim 13, wherein the upper and lower rings are made of plastic.

* * * * *